US005318107A

United States Patent [19]

Bell

[11] Patent Number: 5,318,107

[45] Date of Patent: Jun. 7, 1994

[54] CARRYING BAG

[76] Inventor: Rebecca Bell, 5044 N. Octavia, Harwood Hts., Ill. 60656

[21] Appl. No.: 966,410

[22] Filed: Oct. 26, 1992

[51] Int. Cl.[5] ..... F25B 29/00; B65D 30/08

[52] U.S. Cl. ..... 165/48.1; 383/110; 392/445; 392/448

[58] Field of Search ..... 383/110; 392/445, 458; 165/48.1

[56] References Cited

U.S. PATENT DOCUMENTS

| | | | |
|---|---|---|---|
| 1,336,728 | 4/1920 | Christensen | 392/445 |
| 2,730,151 | 1/1956 | Smith | 383/110 |
| 2,731,182 | 1/1956 | Higgins | 383/110 |
| 3,593,888 | 7/1971 | Brown | 392/445 |

*Primary Examiner*—A. Michael Chambers
*Attorney, Agent, or Firm*—Paul H. Gallagher

[57] ABSTRACT

The bag has a frame of rigid pieces secured together in three-dimensional shape, and panels are secured thereto forming a bottom side wall, end wall, and a pair of top closure panels, the latter being angled forming a gable roof type top. The panels are of limited flexibility enabling them to be bent about long radii. A bottle cooler and an electric warmer are provided, a large central space accommodating a large quantity of diapers forming great heat insulation between the bottle cooler and bottle warmer. The bottle warmer includes and electric cord normally held in a pocket and extendible to the exterior for plugging into a house socket or cigar heater socket in an automobile. The top panels have small sections that can be opened without opening the complete top panels enabling the bottles to be withdrawn and inserted vertically. A changing pad made up of hinged panels is secured to the interior, and is operable to a spread position for lying on a supporting surface, and foldable into a pack that is positionable flat against a side panel and normally held there.

12 Claims, 2 Drawing Sheets

CARRYING BAG

SUMMARY OF THE INVENTION

The carrying bag of the invention is designed for carrying a large number of items of many different kinds.

The bag is adapted particularly to carrying infants' things.

A principal feature of the invention is that the bag is of such design and construction as to render it extremely easy to place the items in the desired locations in the bag, and to render them individually accessible without disturbance of or hindrance by other items.

Other advantages are that the bag includes a cooler unit for cooling bottles of milk; a heater unit for heating a single bottle; and providing good insulation between the cooler and heater units by means of a great quantity of diapers; the carrying bag includes means adapting it to heating the heater unit by the usual electrical circuit in the house, and an adaptor to enable the heater unit to be heated by a cigar lighter in an automobile; the device is of very simple construction, and of relatively low cost of manufacture.

DESCRIPTION OF THE VARIOUS FIGURES OF THE DRAWINGS

DETAILED DESCRIPTION OF THE DRAWINGS

Figure 2:
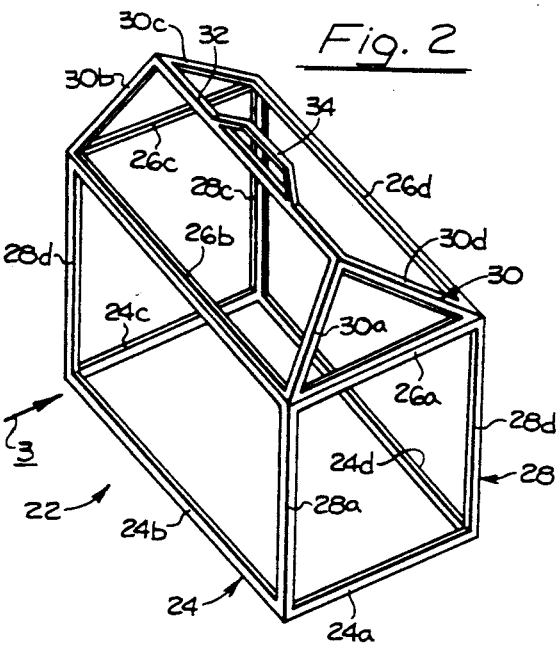
FIG. 2 is a perspective view of the framework of the carrying bag, without the enclosing panels.
Figure 1:
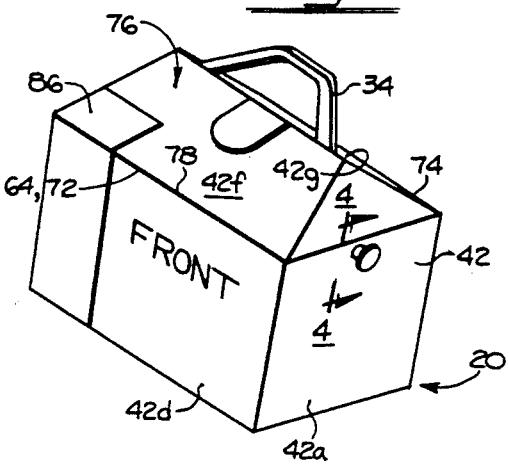
FIG. 1 is a perspective view of the carrying bag of the invention.

Referring in detail to the drawings, attention is directed first to FIG. 1 showing the carrying bag of the invention in its entirety, in perspective view, indicated at 20. Attention is also directed to FIG. 2, showing a framework indicated in its entirety at 22, providing the principal structure of the carrying bag, and on which enclosing panels are placed, to form the completed carrying bag. These enclosing panels are referred to in detail hereinbelow. Briefly the enclosing panels are applied to the framework 22 to form an entire enclosure, at all sides, including the bottom and the top.

The framework 22 is made up of four bottom rails 24, four top rails 26, four posts 28 at the corners, rafters 30, and a ridge rail 32. The ridge rail 32 includes a carrying handle 34 (FIG. 2) which forms a lateral extension from the main part of the ridge rail 32. This handle may be formed by molding it integrally with the rail, or it may be a separate item secured thereto, as desired. All the remaining pieces or sticks, are uniform in cross-sectional shape throughout their length.

These various elements making up the frame work 22, may be referred to generically as pieces or sticks. They are preferably made out of plastic material by any suitable and known process, such as by forming straight pieces and fusing them together, or providing pin-socket structural connections as in FIG. 3. The various sticks of the frame 22 (FIG. 2) are identified generically by reference numerals, and individual ones are further identified by those same reference numerals with postscript letters a, b, c, etc. for facilitating orientation of the various parts of the carrying bag in the views compared with each other.

Figure 3:
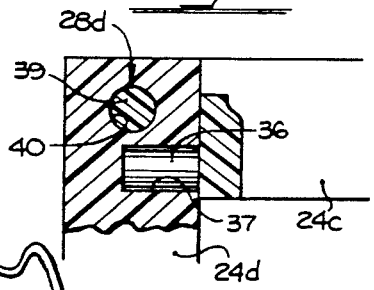
FIG. 3 is a fragmentary detail view of a connection between adjacent frame members, at a position indicated by the arrow 3 in FIG. 2.
Figure 6:
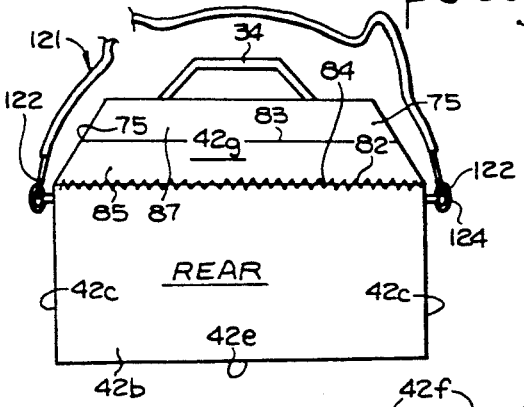
FIG. 6 is a rear view.
Figure 5:
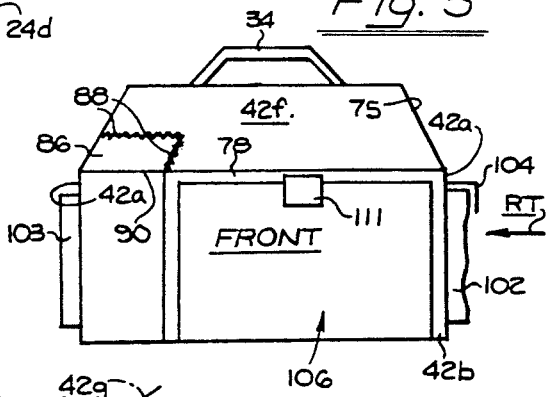
FIG. 5 is a front face view of the carrying bag.
Figure 7:
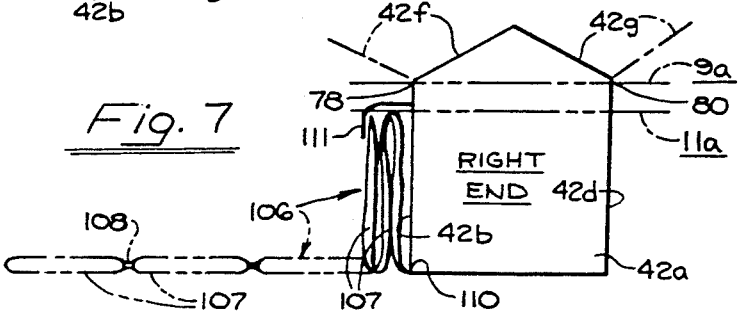
FIG. 7 is a view from one end showing a changing pad in folded position in full lines and in folded out position in dot/dash lines.
Figure 8:
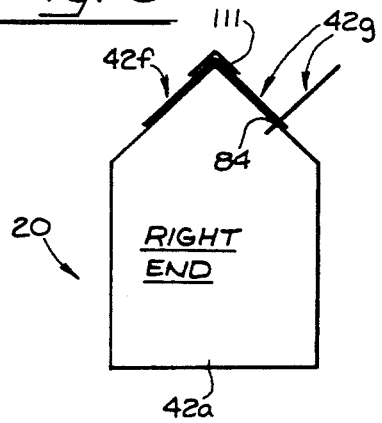
FIG. 8 is a semi-diagrammatic end view of the carrying bag.

FIG. 3, as noted above, which is a fragmentary view of a corner of the frame at the location indicated by the arrow 3 in FIG. 2, shows adjacent sticks 24*c*, 24*d*, the former having a pin 36 fitted in a socket 37 in the stick 24*d*. This view also shows a pin 39 on the stick 28*d* fitted in a recess 40 in the stick 24*d*. This connection is only an example, and any of various kinds of connections may be utilized. It is also within the scope of the invention to mold, or otherwise form the entire frame 22 as a single piece. The details of construction of the frame need not be dwelt upon, it being sufficient to state that the frame includes various elements to support other elements of the bag, and constitute a means for determining and maintaining the shape of the bag.

Reference is again made to FIG. 1 which includes the enclosing panels. The individual panels on the various sides of the carrying bag are further identified all with the same reference numeral 42, with postscript letters a, b, c, etc. to facilitate individual recognition thereof in the various views.

Figure 13:
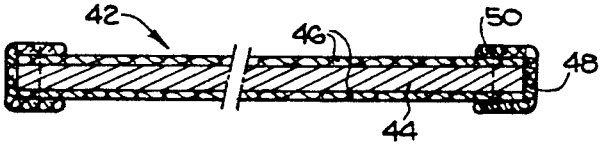
FIG. 13 is a sectional view through an enclosing panel, of exaggerated thickness and proportions.

The enclosing panels 42 may be made of any of various materials, and an example of such a panel is illustrated in FIG. 13. The panel 42 includes a center core 44 which may be a sheet of known plastic material, covered by other sheets, or layers, 46, which may be of cloth or other material. Preferably the side edges of the resulting panel are covered with a binding 48 secured to the body of the panel as by stitching indicated at 50. Various ones (e.g. 46, 48) are shown of exaggerated thickness. Preferably the core or center panel 44 is semi-rigid, that is, it has sufficient rigidity to retain its own shape, such as standing on edge, but it possesses a limited degree of flexibility, in that it can be curved or bent about long radii. The enclosing panels 42, when applied to the frame 22 are held in shape-forming positions, and the resulting carrying bag possesses a substantial degree of rigidity and solidity, but the walls thereof, formed by the panels, possess the limited flexibility referred to above, so as to make the entire carrying bag comfortable to handle.

Figure 17:
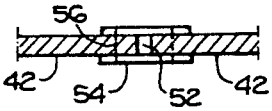
FIG. 17 is a view similar to FIGS. 13-16 of a further detail of construction.

The specific details of affixing the enclosing panels to the framework also may be performed in a known manner, such for example as wrapping sufficient panelling material around the frame to form several panels or wall elements, e.g. the four sides or walls, and secured together at the meeting edges in a suitable manner, such as indicated in FIG. 17. In this figure, the ends of the respective panels or material forming the panels, meet at a meeting edge 52, and binding strips 54 applied over the meeting line, and stitched as indicated at 56 to the edge portions of the meeting panels.

Figure 18:
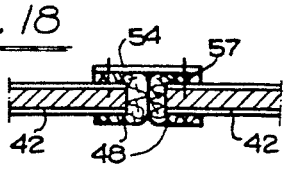
FIG. 18 is a view similar to FIGS. 13-17 of yet another form of construction.

Individual panels 42, which are of single form to cover a single side of the bag, may be secured to other panels in a suitable manner, such as by stitching a further binding strip 54, (FIG. 18) to other bindings 48 already in place, by means of additional stitching 57.

Figure 14:
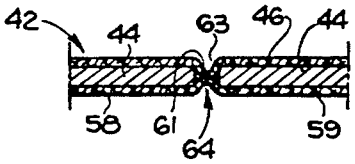
FIG. 14 is a view similar to FIG. 13 showing another detail of construction.
Figure 15:
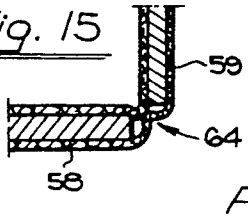
FIG. 15 is a view similar to FIGS. 13 and 14 showing a still different form of construction detail.

While it is desired in most instances, and at most locations of the enclosing panels, in the finished bag, that they be of continuous construction, it is also desired to provide hinging action between individual panels or portions of a panel. Such a hinge means is shown in FIG. 14, where the panel 42 is made up of two panel portions 58, 59 each including a core 44, and a covering 46. The cores 44 in the two portions are spaced apart as indicated at 61, and the covering material is continuous over the two portions as indicated at 63, and these elements 63 extend into, or may extend into, the space between the core elements. This enables the two portions of the panel to flex about these elements 63 and form a hinge means 64 to facilitate bending of the two parts of the panel, as referred to again hereinbelow. This hinge means enables the two portions to be readily and easily bent, as indicated in FIG. 15, the portions 58, 59 being shown in a 90° angle, at a corner of the carrying bag.

Figure 16:
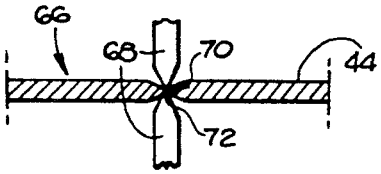
FIG. 16 is a view similar to FIGS. 13-15 of still another detail of construction.

It is also within the scope of the invention to form panels of the kind indicated at 66 in FIG. 16. In this case a panel may consist of only a core element 44, i.e., without covering layers 46, and a pair of opposed rollers 68 are utilized to form opposed grooves on opposite sides, forming a thin element 72, although compressed, which in turn constitutes a hinge means. The two parts of the panel 66 are thus readily flexed or bent about the hinge means.

FIGS. 1, 5–7, show the individual enclosing panels 42 at all sides of the carrying bag, these being identified by the numeral 42 with postscript letters. The carrying bag has a gable shape top 74, with inclined ends 75, the frame 22 and the panels 42*a*, 42*c* being correspondingly shaped.

Figure 9:
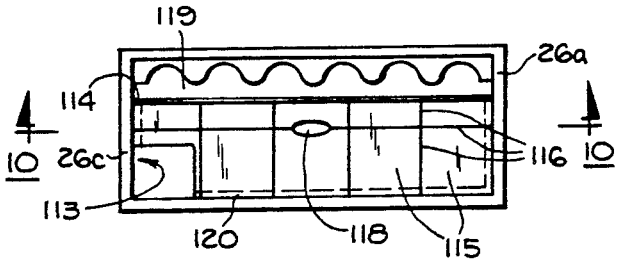
FIG. 9 is a top view of the interior of the bag, at a level indicated by the dot/dash line 9*a* of FIG. 7.
Figure 11:
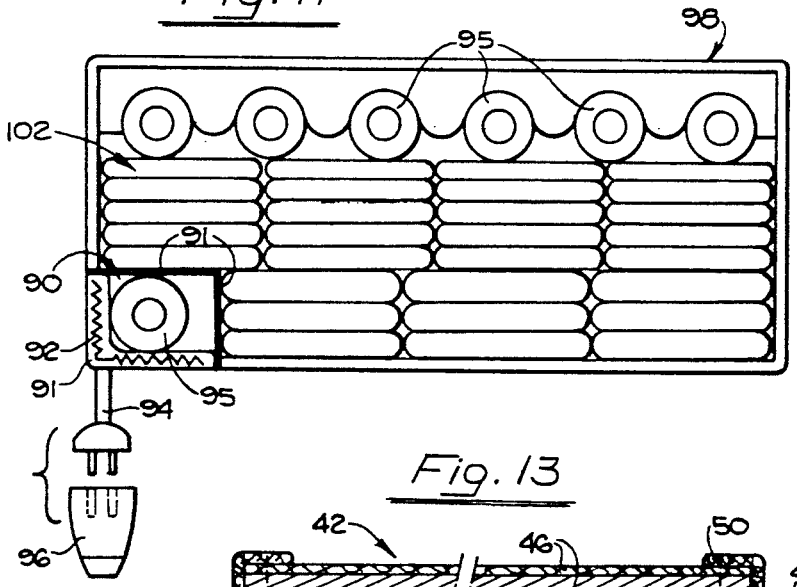
FIG. 11 is a top view of the interior of the bag, at a level indicated by the dot/dash line 11*a* of FIG. 7.

The top of the referred to as a roof, includes front and rear panels 42*f*, 42*g*, swingable from their closed position (FIG. 1) to an outer position (FIG. 7) about their lower edges, 78, 80 where they are connected with the front and rear side panels 42*b*, 42*d*. At the front, the edge 78 is a hinge, 64 (FIG. 14) or 72 (FIG. 16), while on the rear side (FIG. 6), the top panel 42*g* is connected to the side panel 42*b*, at line 82, which is constituted in this case by a zipper 84. These top panels when in opened position expose the entire interior to access from the top (FIGS. 9, 11). The panel 42*g* includes a hinge 83 forming upper and lower panel sections 85, 87, either of which can be opened to the respective compartment without disturbing the other.

Formed in the top panel 42*f* is a cover element 86 (FIGS. 1, 5), connected with the main part of the top panel by zipper elements 88, on two adjacent sides. Upon opening the zipper elements, the cover element 86 can be swung to open position about the line 90 forming a hinge means between itself and the remainder of the side panel 42*d*. This cover element 86 provides access to a bottle-warmer section 90 (FIGS. 5 and 11), formed by wall elements 91 secured to the adjacent enclosing panels. This section includes an electrical heating element 92 arranged in a suitable manner, such as adjacent the exterior side surfaces of the bag. Leading from the electrical heater is a electrical cord 94 having a plug insertable into a socket of the electrical circuit in the house, this pocket holding a bottle 95, which is then heated by the electrical element. The plug on the cord 94 can also be used with an adaptor 96, of known kind, which is usable with the usual cigar lighter in an automobile, for use in traveling. As evident, the bottle 95 in the warmer section may be removed or inserted, through the top opening covered by the cover section 86, without disturbing any other parts or elements of the carrying bag.

Figure 12:
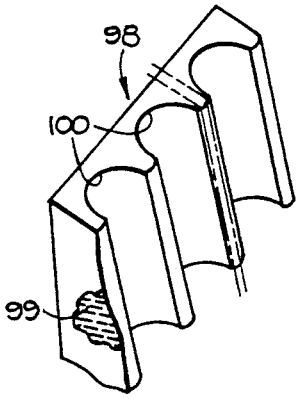
FIG. 12 is a perspective view of the cooling unit shown in FIG. 11.

Also provided in the carrying bag is a cooler unit 98 (FIGS. 11, 12) which is detachably placed in the bag. The unit itself is shown in its entirety in FIG. 12 and is a rechargeable self-contained refrigerating unit of known kind, containing material 99 that can be prefrozen, providing cooling effect for extended periods of time. The unit 98 is provided with a plurality of vertical grooves 100, and is fitted in the bag as shown in FIG. 11, being dimensioned so that it can be easily put in place and removed therefrom, and while in place being held upright. Bottles 95 are fitted in the grooves 100, and are maintained cooled for an extensive period of time.

FIG. 11 shows a quantity of diapers 102 in the main space of the bag, which constitutes the greater portion of the space therein. These diapers are of such quantity, and corresponding thickness, that they provide a high degree of insulation between the heater unit and the cooler unit.

The bag is provided with pouches 102, 103 at the ends, these being made up of material such as that constituting the enclosing panels shown in FIGS. 13–18, and described above. These pouches may be provided with simple covers 104 which are readily swung between closed and opened positions. The covers may be provided with suitable latching elements such as that known as Velcro. These pockets or pouches 102, 103 may be utilized for holding the electric cord 94, and adaptor 96, and similar articles.

The carrying bag also includes a changing pad, indicated in its entirety at 106 (FIGS. 5, 7) and preferably is constituted by a plurality of, such as 3, panel elements 107 interconnected by hinge means 108 of a kind described hereinabove. The changing pad 106 is secured to the bottom edge of the bag at 110, and the panel elements are of such dimension that when they are folded they form a pack fitted against the main part of the bag, and extending upwardly to a position adjacent the top of the vertical side panel. They may be folded out to a usable position shown in dot/dash lines in FIG. 7, and to unused position, in which they are folded as shown in full lines in that figure, and in the latter position, they may be held by a suitable securing means 111 of any suitable kind, such as Velcro material.

Figure 10:
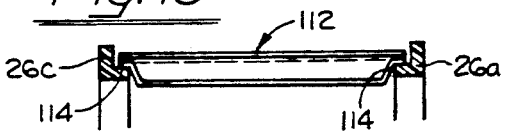
FIG. 10 is a sectional view taken at line 10—10 of FIG. 9.

The carrying bag also includes an accessory tray 112 (FIGS. 9, 10). For this purpose certain of the rails or sticks of the frame, e.g., 26a, 26c are of L-shape in cross section (FIG. 10) having beads 114. The tray 112 is fitted in place between those rails, and rests on the beads. The tray is provided with a notch or cut-out 113 to accommodate the bottle in the cell 90, and is dimensioned in width at 114, at the opposite edge so as not to cover the bottles in the cooler unit 98, enabling the bottles to be grasped at the top and lifted out upwardly.

The tray 112 is preferably provided with a plurality of cells 115 (FIG. 9) formed by walls 116 or carrying various small assorted items. The tray may be provided with a finger hole 118 for use in putting the tray in place and removing it therefrom. The tray is provided with a suitable cover 119 secured in a suitable manner, such as by hinging at 120, and provided with a clasp for holding it in closed position.

Figure 4:
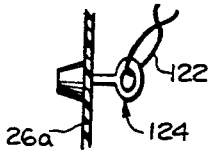
FIG. 4 is a detail sectional view taken at line 4—4 of FIG. 1.

In addition to the carrying handle 34 identified above, the bag is provided also with a carrying shoulder strap 121 (FIG. 6) of suitable length, having snaps 122 (FIG. 4) at its ends for snapping in eyelets 124 on the bag. The eyelets may be mounted in a suitable manner, such as shown in FIG. 4, where there are screwed into the corresponding rails 26a, etc.

The order of applying the panels 42 to the frame may be varied, as for example, material of greater length to form a plurality of individual panels may be applied, or each of the panels may be individually cut, and individually applied.

I claim:

1. A carrying bag comprising, an outer enclosing casing including a plurality of panels including, a bottom floor panel, side wall panels, end wall panels, top panels, the panels being semi-rigid, capable of maintaining their shape in upright position, but capable of being flexed a limited amount, means mounting the top panels on the wall panels on hinges at the top of the wall panels for swinging the top panels to full open position while the wall panels remain in full upright position, exposing substantially the entire interior of the bag to the exterior, means for receiving and retaining selected articles in the interior the bag at opposite sides of the bag, respectively, and, the top panels having sections, less than the whole, that constitute closure elements positioned corresponding to said selected articles, and operable independently of the top panels, for exposing said selected articles.

2. A carrying bag according to claim 1 and including, a cooling compartment including cooling means in the cooling compartment for receiving bottles and retaining the goods therein cool, and a heating compartment including heating means for receiving a bottle and heating the goods therein, said cooling and heating compartments being positioned for opening and closing by said closure elements, and those compartments, and thereby the closure elements being spaced apart.

3. A carrying bag according to claim 2 wherein, the cooling means includes a rechargeable self-contained cooling unit having vertical channels for receiving individual bottles, and one of said closure elements being operable for exposing the bottles in said channels and enabling them to be withdrawn upwardly from the carrying bag.

4. A carrying bag according to claim 2 wherein, the cooling means includes a self-contained unit separate and detachable from the enclosing casing and thereby removable therefrom, the enclosing casing and the cooling unit are so relatively dimensioned and proportioned that the cooling unit can be fitted against a side wall of the enclosing casing and confined by the adjacent opposite end walls thereof, and thereby enabling retention of the cooling unit against said side wall by articles in the central portion of the interior of the carrying bag.

5. A carrying bag according to claim 2 wherein, the heating compartment includes a cell with side walls and an opening at the top, an electrical heating element on said side walls surrounding a central area in the heating compartment for receiving a bottle, said cell having a top opening enabling insertion therethrough of a bottle into and out of said cell.

6. A carrying bag according to claim 5 wherein, said cell is adjacent an end wall of the carrying bag, the carrying bag has an end pocket on the exterior of said end wall, and the carrying bag includes and electric cord connected to said heating element and extended through said end wall into said end pocket, and the end pocket being capable of holding the portion of the electrical cord extended from the heating element in folded form therein, and enabling extension of the cord therefrom in unfolded condition for plugging into a socket.

7. A carrying bag according to claim 6 wherein, the carrying bag has a second pocket on the exterior of a second end wall.

8. A carrying bag according to claim 2 wherein, the cooling compartment and heating compartment cover a horizontal area less than that of the entire carrying bag, the carrying bag includes top closing panels, and said smaller sections are positioned in register respectively with the cooling and heating compartments, and are operable while leaving the main portions of the top closing panels in closing position, enabling movement of bottles through openings provided by said smaller sections with the top closing panels remaining in closing position.

9. A carrying bag according to claim 1 and including, a changing pad made up of a plurality of sections hinged together, a lower section being hingedly connected with a side wall at the bottom and on the exterior of that side wall, the sections being foldable into a pack fitted upright against that side wall and unfoldable into pad form for lying on the surface supporting the carrying bag.

10. A carrying bag comprising, a frame and an outer enclosing casing thereon, the frame being made up of relatively rigid pieces secured together to form a rigid frame, the enclosing casing being made up of panels that are somewhat rigid but possess limited flexibility, the panels being secured to corresponding bounding flat side surfaces of the frame, and at least certain of the panels being secured together by hinge means enabling certain of them to be swung to open position for exposing the interior of the carrying bag.

11. A carrying bag according to claim 10 wherein, at least certain of the panels are interconnected by zippers which constitute at least certain of said hinge means, at least certain of the panels so interconnected by zippers being also connected at edges opposite the edges at which they are connected to the zippers to adjacent panels by hinge means thereby being swingable about said opposite edges.

12. A carrying bag according to claim 10 wherein, the panels possess sufficient rigidity to stand upright, but sufficient flexibility to be bent about long radii.

* * * * *